US008302517B2

(12) United States Patent
Fahrenbach

(10) Patent No.: US 8,302,517 B2
(45) Date of Patent: Nov. 6, 2012

(54) PRESS WITH CUTTING SHOCK DAMPENING

(75) Inventor: Juergen Fahrenbach, Aichelberg (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 939 days.

(21) Appl. No.: 11/593,055

(22) Filed: Nov. 6, 2006

(65) Prior Publication Data

US 2007/0101841 A1 May 10, 2007

(30) Foreign Application Priority Data

Nov. 7, 2005 (DE) ..... 10 2005 053 350

(51) Int. Cl.
*B26D 7/06* (2006.01)

(52) U.S. Cl. ..... 83/137; 83/684; 83/686; 83/697

(58) Field of Classification Search ..... 83/13, 137, 83/639.1, 684, 686, 697, 690, 694, 457; 100/269.14, 100/273
See application file for complete search history.

(56) References Cited

U.S. PATENT DOCUMENTS

| | | | | |
|---|---|---|---|---|
| 2,290,743 | A * | 7/1942 | Ernst | 72/351 |
| 3,570,343 | A * | 3/1971 | Wolnosky et al. | 83/124 |
| 5,168,738 | A | 12/1992 | Bielfeldt | |
| 5,253,559 | A * | 10/1993 | Philippe et al. | 83/133 |
| 5,413,018 | A * | 5/1995 | Wada et al. | 83/456 |
| 5,673,601 | A | 10/1997 | Ejima et al. | |
| 5,749,279 | A * | 5/1998 | Gardner | 83/639.1 |
| 6,128,987 | A * | 10/2000 | Nakagawa et al. | 83/76.9 |
| 6,240,818 | B1 * | 6/2001 | Baltschun | 83/137 |
| 6,920,821 | B2 * | 7/2005 | Ariji | 100/35 |
| 6,964,225 | B2 * | 11/2005 | Gubler et al. | 100/214 |
| 2008/0196471 | A1 * | 8/2008 | Fellenberg et al. | 72/324 |

FOREIGN PATENT DOCUMENTS

| | | | |
|---|---|---|---|
| DE | 28 04 185 | A1 | 8/1978 |
| DE | 40 31 645 | A1 | 4/1992 |
| DE | 41 28 610 | A1 | 4/1992 |
| DE | 102 52 625 | A1 | 5/2003 |
| EP | 0 531 141 | A1 | 3/1993 |
| EP | 1 602 419 | A1 | 12/2005 |
| WO | WO 2005/120741 | A2 | 12/2005 |

OTHER PUBLICATIONS

European Search Report dated Apr. 22, 2008 w/English translation of pertinent portion (eleven (11) pages).

* cited by examiner

*Primary Examiner* — Boyer D Ashley
*Assistant Examiner* — Omar Flores Sanchez
(74) *Attorney, Agent, or Firm* — Crowell & Moring LLP

(57) ABSTRACT

To increase the cutting quality and to improve the operation of a press, in particular in punching high-strength martensitic materials or when punching thick sheet metal, a sheet metal holding device is provided for securely clamping the respective workpiece during the punching operation. The clamping force is increased to 40% or more of the ram force. The force exerted by the sheet metal holding device during the penetration of the workpiece can be further increased. The increase in the clamping force preferably takes place in a controlled manner as a function of the press angle.

12 Claims, 3 Drawing Sheets

PRESS WITH CUTTING SHOCK DAMPENING

RELATED APPLICATIONS

This application claims priority to German Patent Application 10 2005 053 3503.7, filed Nov. 7, 2005, the contents of which are incorporated herein by reference in their entirety.

BACKGROUND AND SUMMARY OF THE INVENTION

The present invention relates to a press that is set up for cutting thick and/or, more particularly high-strength sheet metal as well as a method for operating such a press.

When punching or cutting high-strength sheet metal, great fluctuations in forces occur between the ram and the punching die over time and can also change suddenly in particular. As long as the material of the workpiece resists the stamp, a very high force prevails, so that some parts of the press undergo elastic deformation. This pertains to the press bed, the punching die, the press stands, the press head piece and to a certain extent also the ram plus the connecting rod and the eccentric shaft. If the workpiece yields under the influence of the stamp, then the energy stored elastically in the aforementioned elements is released in a relatively uncontrolled manner.

To be able to monitor this process better, DE 102 52 625 A1 proposes a system for reducing the cutting shock, in which a number of hydraulic cylinders are provided in the die. These may be arranged above, below or at the side of the workpiece. Sensors such as ultrasonic sensors or sensors that measure the flow rate of hydraulic fluid flowing out of the hydraulic cylinders cause the closing of a valve through which the hydraulic fluid could previously flow out of the hydraulic cylinders. The hydraulic cylinders are connected to pressure accumulators that are under a relatively high pressure. They therefore now generate a high counterforce. The force previously exerted by the stamp on the workpiece is thus transmitted at that moment to the hydraulic cylinders in which the stamps begin to penetrate through the workpiece.

This method of dampening the cutting shock has proven fundamentally successful, but the adjustment of the sensors for detecting penetration of the workpiece is critical. Even when the hydraulic cylinders are arranged next to the workpiece, there is still a certain cutting shock which should be further reduced.

Against this background, an object of the present invention is to improve upon the state of the art as defined above.

This object has been achieved with a press having a controllable supporting device that is set up for generating a variable force that is effective between the ram and the press bed, and a control unit that is assigned to the supporting device and detects by means of a sensor device a quantity that is in a unique correlation with the ram position and that influences the force exerted by the supporting device and acting between the ram and the workpiece as a function of the quantity and a method whereby force applied by the supporting device us varied as a function of a quantity related specifically to ram position.

The press according to the present invention has a supporting device that is active between the ram and the press bed and creates a force acting between them. For example, the supporting device is part of the sheet metal holding device that presses the die against the lower die during the forming operation. For example, the lower die is a punching die, and the upper die is a stamp. The sheet metal holding device, which is configured as a supporting device, is capable of exerting various forces. A control unit assigned to the supporting device is capable of influencing the force exerted by the supporting device.

The control unit influences the force exerted by the supporting device according to this invention on the basis of a parameter that is uniquely related to the position of the ram. This parameter may be, for example, the ram position itself or, as is preferred, the press angle or some other measured quantity. If the press angle is used as the basis, then a press driven by a rotating shaft, such as that with eccentric presses, toggle presses or the like, is assumed. The rotational position of the drive shaft, in particular the eccentric shaft, is referred as the "press angle." The press angle (or the other parameter uniquely characterizing the position of the ram) with which a sudden increase in the counterforce exerted by the supporting device is preferably to take place is, for example, predetermined and preset by the die manufacturer. It is contemplated to provide for this preset value of the press angle at which the reversal of force takes place to be corrected in braking in the press, i.e., to be varied on a trial basis to achieve the smoothest possible operation of the press in the sense of maximum dampening of the cutting shock. The value thus set is preferably saved and then used for subsequent operation of the press.

The set value for the press angle may be defined specifically for a given die and workpiece. Such values may be stored in a retrievable form in a table, so that new settings for the press angle at which the reversal of force takes place with the supporting device will be available in retrofitting the press.

Due to the reversal of the supporting force that is performed in the simplest case exclusively on the basis of the press angle, the press may easily be set for different particulars, especially with regard to the number of strokes or the cutting force.

As a rule, a hold-down plate, which is supported directly on the workpiece, belongs to the sheet metal holding device. The hold-down plate extends to the immediate vicinity of the stamps (punching stamps) and thus approaches the cut to be produced in close proximity. The sheet metal should thus be clamped tightly in the immediate vicinity of the cut between the hold-down plate and the lower die (punching die) to achieve a high-quality cut. With the press of the present invention, the sheet metal holding device or some other supporting device preferably receives the force applied by the ram after the stamp breaks through the workpiece while the ram is passing through its bottom dead center and saves the energy thereby emitted by the ram in between. In the return stroke of the ram, this energy is delivered back to the ram and thus to the press drive. By avoiding in this manner, uncontrolled release of the energy stored elastically in the press, the press drive is relieved on the whole, i.e., energy is saved.

The mechanical load on the press is reduced by avoiding excessive sudden changes in force with the present invention. In addition, due to the transfer of force exerted on the ram to the sheet metal holding device until the penetration of the workpiece, an especially tight clamping of the workpiece is achieved precisely during penetration, so that especially high cutting qualities are achieved. Furthermore, the force may be introduced over an especially large area by way of the sheet metal holding device and may thus be introduced gently into the workpiece, so that unwanted deformation thereof, e.g., pinching and the like, can be avoided.

It is also contemplated to detect and monitor the characteristic of the ram force as a function of time or as a function of the press angle. If it goes beyond a predetermined tolerance range as a function of the press angle, the reversal point in time (reversing press angle) for the counterforce applied by the supporting device may be shifted forward or in reverse. This allows a high number of strokes in particular to be achieved.

The sheet metal holding device and/or the supporting device preferably has a hydraulic cylinder that is connected to a first and a second hydraulic pressure accumulator(s). Both of the pressure accumulators have, for example, a displaceably mounted piston with a dampened end stop. Diaphragm accumulators or accumulators in which a gas pressure cushion is directly connected to the hydraulic fluid may be provided as an alternative. Both pressure accumulators preferably have different resting pressures. The path leading from the hydraulic cylinder to the pressure accumulator with a low pressure is preferably regulated by an electrically controlled valve that is controlled by the control unit.

The reversal of the supporting force, preferably from a lower value to a higher value, at a predetermined press angle allows starting of the reversal operation of the hydraulic valve shortly before the press angle at which the counterforce applied by the workpiece collapses, e.g., because the punch punctures through the material of the workpiece. The press angle difference by which the hydraulic valve is opened in the leading phase can be referred to as the "correction angle." With this angle, time delays caused by the reversal of the hydraulic valve and by the delayed response of other components can be compensated effectively. In contrast with that, systems that use parameters characterizing the collapse of force on the workpiece for reversal of the hydraulic valve can only respond subsequently, i.e., with a time lag. The present invention thus permits effective compensation of the cutting shock that would otherwise occur, especially with a rapid operating speed of the press (high number of strokes).

BRIEF DESCRIPTION OF THE DRAWINGS

Other objects, advantages and novel features of the present invention will become apparent from the following detailed description of the invention when considered in conjunction with the accompanying drawings, in which.

DETAILED DESCRIPTION OF THE DRAWINGS

Figure 1:
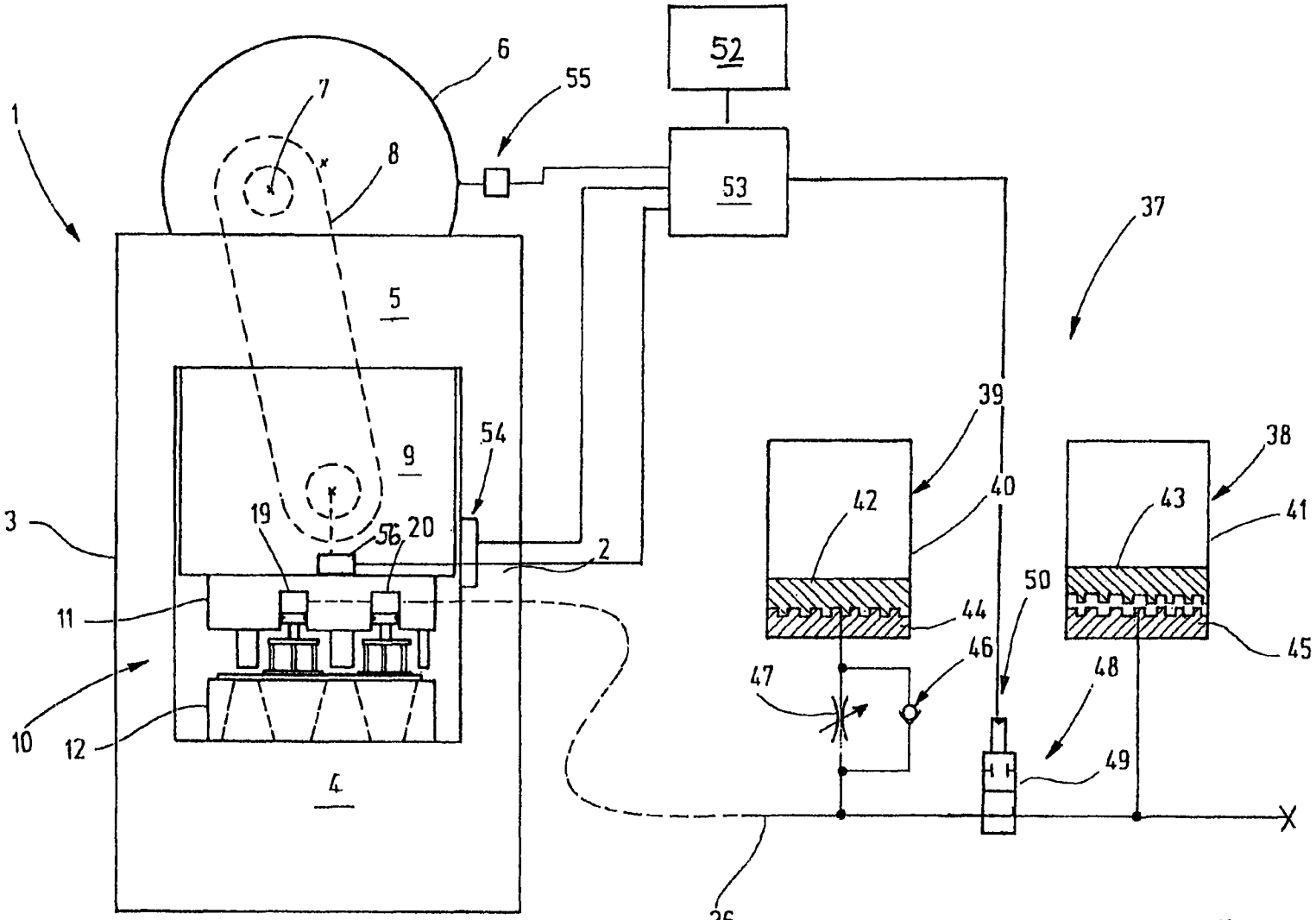
FIG. 1 is a schematic showing of the press of the present invention.
Figure 2:
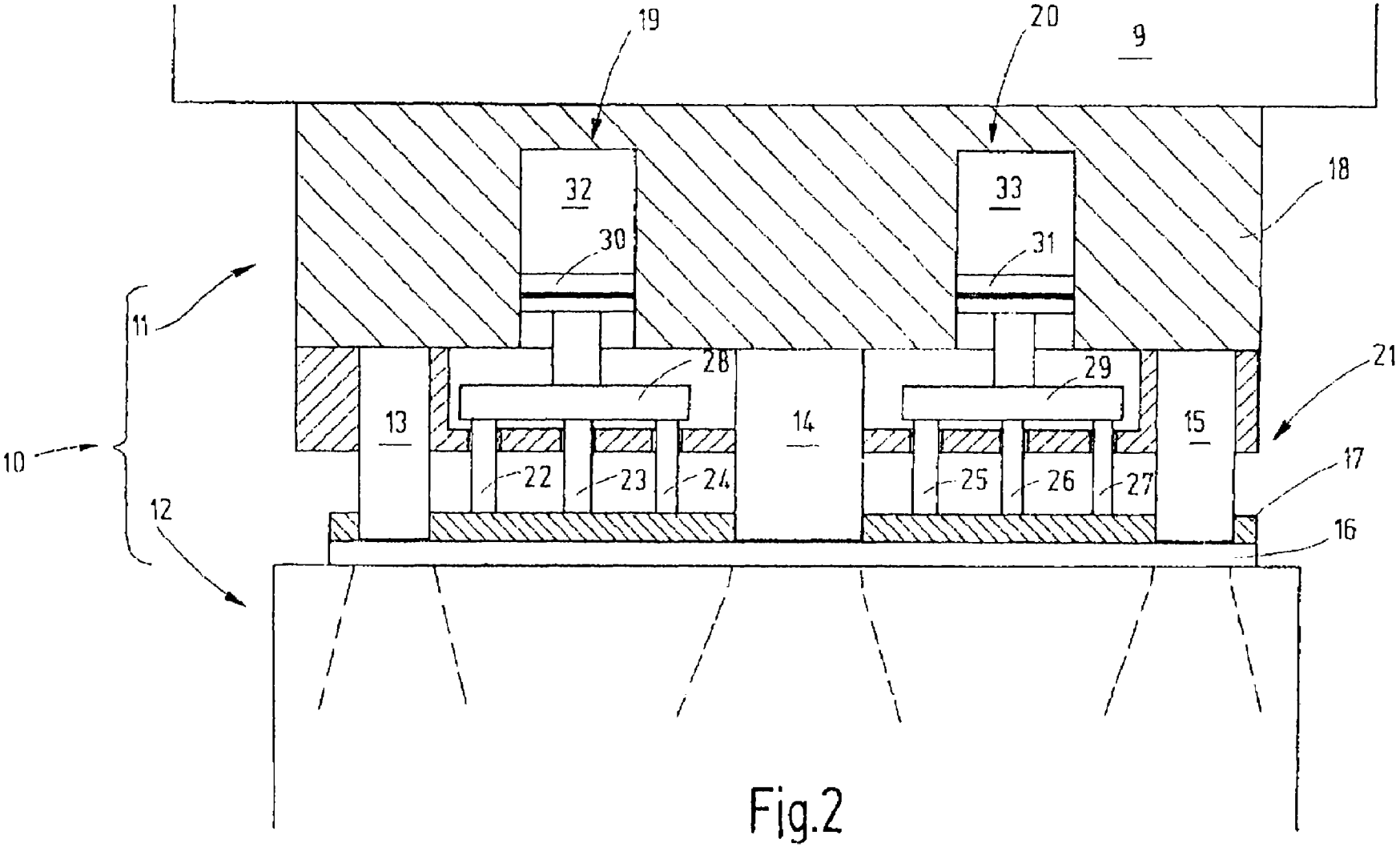
FIG. 2 is a side cross-sectional schematic view showing the die of the press according to FIG. 1.

In FIG. 1 a press 1 is shown having a press frame with press stands 2, 3, a press bed 4 and a head piece 5. A drive 6, e.g., an electric motor, is mounted on the head piece 5, for driving a ram 9 back and forth via an eccentric cam 7 (illustrated schematically and shown with dotted lines), and a connecting rod 8 (also shown with dotted lines). Between the ram 9 and the press bed 4, a die 10 is provided and has an upper die 11 and a lower die 12. The lower die 12 is designed as a punching die. The stamps 13, 14, 15 are mounted on the upper die 11, shown especially in FIG. 2, along with the other details of the die 10. The die 10 serves to punch a workpiece 16 illustrated as a planar workpiece in FIG. 2. However, workpieces that are not yet planar may, of course, be subjected to a punching operation accordingly. In this case, the lower die 12 will have a contour corresponding to that of the non-planar workpiece.

The upper die 11 also includes a sheet metal folding plate 17 that is held on a base body 18 of the upper die 11. The base body 18 connected to the ram 9 carries the stamps 13 through 15 that are thereby rigidly connected to the ram 9. In addition, the base body 18 contains one or more hydraulic cylinders 19, 20 that, together with the sheet metal holding plate 17, form a sheet metal holding device 21.

The sheet metal holding device 21 also includes pressure pins 22 through 27 that are arranged approximately or exactly in parallel with the stamps 13 through 15 and supported at their lower end faces on the sheet metal holding plate 17. The pins are otherwise essentially cylindrical and are supported at their upper ends on floating plates 28, 29 that are thus resting on the pressure pins 22 through 27 at the top. The pistons 30, 31, which border and seal corresponding work areas 32, 33 filled with hydraulic fluid in the hydraulic cylinders 19, 20 as well as being displaceably mounted therein, belong to the hydraulic cylinders 19, 20. The piston rods 34, 35 of the pistons 30, 31 press from above on the floating plates 28, 29 and thus push the sheet metal holding plate 17 against the workpiece 16.

The hydraulic cylinders 19, 20 are connected by a fluid line 36 indicated schematically in FIG. 1, to a hydraulic system designated generally by numeral 37 that serves to create a sheet metal holding force and at the same time to transfer the force exerted by the ram 9 during and after penetration through the workpiece 16. Transfer of force should take place as smoothly as possible, i.e., without any sudden changes in force. The sheet metal holding device thus forms a supporting device which creates a controlled force between the ram 9 and the press bed 4.

The hydraulic system 37 also includes a first pressure accumulator 38 and a second pressure accumulator 39, both of which are illustrated by way of example, as pressure storage cylinders 40, 41 with pistons 42, 43 that are displaceably and sealingly mounted therein. The two pistons 42, 43 each divide two working chambers in the pressure storage cylinders 40, 41, the upper working chamber of each being filled with a gas cushion. The pressure accumulator 38 is under a pressure of approximately 200 bar, for example, while the pressure accumulator 39 is under a pressure of 400 bar, for example.

The pistons 42, 43 preferably have profiling on their lower side facing the respective terminating pieces 44, 45. This profiling is complementary to profiling of the respective terminating piece 44, 45. The profiling is formed by straight or curved strips or webs, e.g., in the form of concentric rings, whereby the strips or webs of each piston 42, 43 fit into suitably shaped recesses in each terminating piece 44, 45. The profiling serves as dampening for the end position, so the pistons 42, 43 are braked gently when they run against the connection pieces 44, 45.

The two pressure accumulators 38, 39 are connected to the fluid line 36. The pressure accumulator 39 is preferably connected to the fluid line 36 by a nonreturn valve 46 and a throttle device 47. The nonreturn valve 46 is oriented so that hydraulic fluid can flow unhindered out of the hydraulic line 36 and into the pressure accumulator 40, while it is forced to pass through the throttle device 47 on its return path.

The pressure accumulator 38 is connected to the fluid line 36 and thus to the hydraulic cylinders 19, 20 by a valve mechanism 48. The valve mechanism 48 contains, for example, a two-way valve 49 that can be switched between two states. In a first state, the valve mechanism 48 allows fluid to flow into and out of the pressure accumulator 38 unthrottled and unhindered (or in an alternative embodiment, it may also be simply throttled), whereas it blocks this fluid flow in another state. It is thus configured as an on/off valve. The valve mechanism 48 is connected to an electric operating device 50 that is, in turn, connected to a control unit 53 preferably configured as a microprocessor control unit or as an electronic control unit that is otherwise suitable. It may also be configured as an independent control unit for the die 10 or as part of the other press control. The control unit 53 is preferably connected to or provided with a suitable input/output system 52, such as a display screen, a keyboard or the like. Operating parameters for control of the hydraulic system 37 may be input via this input/output system 52. The press angle ∝ at which the valve device 48 should be reversed is one such operating parameter, for example.

In addition to other input signals, the control unit 53 receives at least one position signal that characterizes the press angle, for example. The position signal may originate, for example, from a sensor 54 that detects the position of the ram 9 especially in the vicinity of its bottom dead center, as a displacement transducer. Additionally or alternatively, a sensor 55 may be provided for detecting the angular position of the eccentric shaft, i.e., the press angle in at least one rotational angle range, in which the ram 9 is near its bottom dead center.

In a currently preferred embodiment, a sensor 56 is provided in the form of a force sensor that detects the force exerted on the workpiece. To do so, for example, the sensor 56 is mounted at the connection point of the connecting rod 8 to the ram 9. If several connecting rods are provided, sensors may be mounted at each of the articulation points, each then being connected to the control unit 53, like the sensor 56. The force exerted by the ram 9 is detected by the sensor 56. This force is the sum of the force exerted on the workpiece and the force picked up by the sheet metal holding device 21. Alternatively, corresponding force sensors can also be provided at other locations, e.g., as deformation sensors in the press bed 4 or as force sensors in the upper die 11 and/or the lower die 12.

The control unit 53 is set up for reversal of the two-way valve 49 at a certain predetermined press angle, so that it becomes blocking. This press angle occurs shortly before bottom dead center at the location where a punching operation to be performed on the workpiece is expected to lead to separation of material. The position of the cam at which this occurs is referred to as the penetration angle. The penetration angle occurs shortly before bottom dead center of the ram 9. After passing through bottom dead center, the control unit 53 may reopen the valve mechanism 48.

To illustrate how the press 1 operates in a first embodiment, a single punching stroke is described. To perform same, the workpiece 16 is first placed on the lower die 12 and then the ram 9 is lowered. The sheet metal holding plate 17 is in its bottom position here, in which it is positioned with its bottom side at least slightly below the end faces of the stamps 13, 14, 15. Before the sheet metal holding plate 17 sits on the workpiece 16, the pistons 30, 31 in the hydraulic cylinders 19, 20 are at rest. The hydraulic fluid is under a resting pressure in the hydraulic system 37.

As soon as the sheet metal holding plate 17 sits on the workpiece 16, the plate 17 presses the workpiece 16 against the lower die 12. The sheet metal holding plate 17 thus remains stationary, while the ram 9 continues to move in the direction of the workpiece 16. Likewise, the pressure pins 22 to 27 remain stationary along with the floating plates 28, 29 and the pistons 30, 31. Subsequent to the further downward movement of the ram 9, the volume of the working chambers 32, 33 is thus reduced and the hydraulic fluid is driven through the fluid line 36 and the open two-way valve 49 of the valve mechanism 48 into the pressure accumulator 38 that has a lower resting pressure than the pressure accumulator 39. Thus, the piston 43 in FIG. 1 is moved upward against the force of the upper gas cushion. Because of the higher pressure prevailing in the pressure accumulator 39, the piston 42 remains in the bottom position.

The end faces of the stamps 13, 14, 15 are then lowered onto the workpiece 16, which presents a considerable resistance to the penetration of the stamps 13, 14, 15. Thus, the movement of the stamps 13, 14, 15 is initially stopped. The driving power of the driving device 6 is then briefly used to elastically deform (i.e., apply stress to) the drive train and the press frame, including the press bed 4 and the lower die 12. An increasingly greater force is thus built up until finally the stamps 13, 14, 15 penetrate through the workpiece 16. The press angle (penetration angle) at which this occurs is known as an operating parameter by the control unit. It therefore monitors the press angle continuously, or at least in the vicinity of bottom dead center, and reverses the valve device 48 on reaching the penetration angle. The hydraulic line leading to the pressure accumulator 38 is thus cut off. As an alternative, the reversal of the valve device 48 may also take place just before reaching the penetration angle, i.e., with a lead with regard to the angle or time. The required correction angle can, for example, be input via the input/output device 52.

If the two-way valve 49 is then closed, no more hydraulic fluid can enter the pressure accumulator 38. Therefore, the fluid must escape into the pressure accumulator 39, which is under a much higher pressure. Thus, the hydraulic cylinders 19, 20 are now generating a considerable counterpressure, which is supported first on the sheet metal holding plate 17 and secondly counteracts the ram 9. The force picked up so far by the rams 13, 14, 15 is thus commuted or transferred onto the sheet metal holding device 21, so that the press, which is under pressure, cannot be depressurized. The ram then passes through bottom dead center against the high force of the sheet metal holding device, whereby the sheet metal holding device then pushes the ram 9 upward with a great force in the first phase of the upward stroke. In this phase, the elastic energy stored in the press 1 is returned to the ram 9 and thus to the drive device 6.

The re-reversal of the valve device 48 may take place at a predetermined press angle after bottom dead center and via the control unit 53 on the basis of the monitored press angle. Alternatively, it is also contemplated to provide the pressure accumulator 39 with a sensor device, e.g., a proximity switch, that recognizes the proximity of the piston 42 to the terminating piece 44. As soon as the piston has reached or almost reached the terminating piece 44, the valve 48 can be opened again to reactivate the pressure accumulator 38. The corresponding sensor is connected to the control unit 53.

Alternatively, the fluid line 36 may be connected to a pressure sensor that is connected to the control unit 53. The latter then reverses the valve mechanism 48 back to the open state when the fluid pressure prevailing in the fluid line 36 drops below a given limit value which is approximately on the order of the pressure of the pressure accumulator 38.

Figure 3:
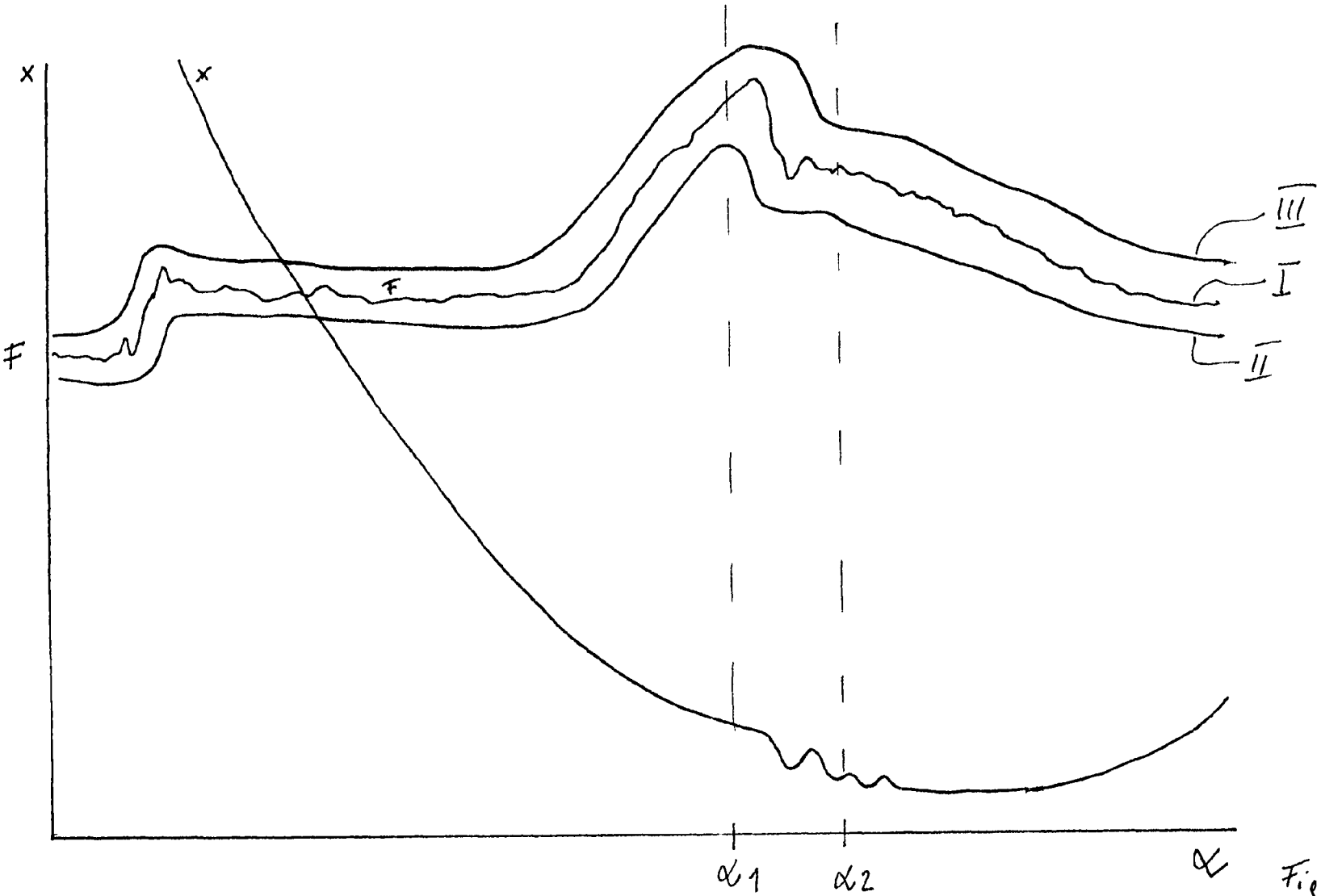
FIG. 3 is a diagram illustrating the ram stroke and the ram force as a function of the press angle.

In addition, in a further embodiment, it is contemplated to monitor the force exerted by the ram 9 by the sensor 56. This yields the time characteristic I of the force F, illustrated in FIG. 3 as an example, having a peak in the vicinity of bottom dead center of the time characteristic of the movement X of the ram, also as shown in FIG. 3. It is also contemplated to monitor whether this expected curve I remains inside or outside of a tolerance band. The tolerance band may be predetermined by two other time characteristics II and III that are obtained by a corresponding X and ∝ offset of the expected force curve I. If the curve I of the ram force actually occurring leaves the tolerance band, the control unit 53 reverses the valve mechanism 48. This is true in particular when the curve I intersects the curve II from top to bottom. The reversal of the valve mechanism 48 from the open state to the closed state at this moment causes an increase in the counterforce on the ram, thus avoiding a sudden, i.e., drastic, drop in force.

The opposite reaction may be obtained when the curve I breaks through the upper limit III. The function of monitoring the curve I, for whether or not it leaves the tolerance band, can be limited to an angle window $\propto 1$, $\propto 2$ in which the penetration angle is expected.

As an alternative, the time characteristic of the force measured by the sensor 56 may be determined. If the drop in force, i.e., the negative slope of the curve I, is too steep, this may be recognized by the control unit 53 as penetration through the workpiece 16. Based on this, the control unit 53 may immediately close the valve mechanism 48. Alternatively or additionally, the stored penetration angle may be corrected to the value determined then. This yields an adaptive, i.e., self-learning, control unit 53 that adapts itself automatically during operation with regard to the penetration angle. The optimization goal is to minimize the drop in force occurring between the angles $\propto 1$ and $\propto 2$ in curve I according to FIG. 3. The control unit 53 may be configured to do so automatically by adjusting the correction angle. However, the angle can be presented manually, as mentioned above.

The penetration angle can also be dynamically adapted by first setting it approximately, monitoring the variations in force and thus determining the actual current penetration angle. Then the press angle of the stamp penetration is selected to be the press angle from the previous stamp stroke or an average value of the previous stamp strokes. It is also contemplated to accommodate force sensors in the press frame, the press bed or other parts of the press, such that these sensors respond to deformation in the respective press element or respond directly to a force acting in the press. These may include, for example, force sensors in the die 10. The signals emitted by these sensors may be sent to the control unit 53 and serve to ascertain the penetration angle.

The system of the present invention permits of the present invention a significant increase in the hold-down force, in particular while performing the punching operation, i.e., while the stamps 13, 14, 15 are penetrating through the material of the workpiece. The actual cutting force can thus be reduced to one-sixth of the theoretical shearing force. The sheet metal holding device 21 produces especially secure clamping of the workpiece 16 and thus improves the cut as well as the dampening of cutting shock. The press 1 is under prestress, so that play is equalized or compensated. In comparison with traditional systems for dampening the cutting shock, this reduces the total pressing force of the system. Older presses can still be used, however, for difficult cutting operations. The force exerted on the sheet metal holding plate is preferably designed for approximately 40% of the pressing force. The separation method may be monitored, analyzed and controlled by using a fast analyzing and controlling device, e.g., control unit 53. The system may also be designed and used autarchically, i.e., independently of the press 1. For example, it may be part of the die and thus may be used in different presses in principle. When there is a change in press specifications, press-specific parameters may be varied through the program or through plant-specific flashcards.

The pressures in the hydraulic cylinders 19, 20 may be monitored continuously as a function of angle or distance. The resulting envelope curves allow continuous monitoring of the process. The bypass valve 52 is triggered as a function of the crank angle or distance using the same system. The process data and trouble incidents may be stored on data storage systems and traced in the event of damage. Furthermore, systems may also be provided for acquisition of overload cases.

To increase the cut quality and improve the operation of a press in particular in punching high-strength martensitic materials or in punching thick sheet metal, a sheet metal holding device is provided to securely clamp the respective workpiece during the punching operation. The clamping force is increased to 40% or more of the ram force. In particular, the force exerted by the sheet metal holding device may be further increased during penetration of the workpiece. The increase in clamping force preferably takes place in a controlled manner as a function of the press angle. First, this improves the quality of the cut, while on the other hand permitting efficient reduction or prevention of cutting shock on the press. Any cutting shock is significantly diminished or does not occur at all.

The invention claimed is:

1. A punch press for punching a workpiece, comprising a press frame having a press bed for holding a lower die and a movably-mounted ram operatively connected to a drive device and carrying an upper die, a controllable supporting device configured to generate a variable force that is effective between the ram and the press bed, and a control unit which includes a reversing hydraulic valve and which is operatively associated with the supporting device to detect via a sensor device a measured ram position or a press angle that has a unique correlation with a ram position and that influences a supporting force exerted by the supporting device and acting between the ram and the workpiece as a function of the press angle or the measured ram position such that the supporting force is increased from a lower value to a higher value to allow a reversing operation of the hydraulic valve at a predetermined press angle just prior to a press angle at which a counterforce exerted by the workpiece during punching ceases.

2. Press as claimed as claim 1, wherein the sensor device is a rotational position sensor.

3. Press as claimed in claim 2, wherein the rotational position sensor is configured for detecting the press angle in increments.

4. Press as claimed in claim 1, wherein the sensor device is a distance measuring device.

5. Press as claimed in claim 1, wherein the supporting device is associated with the die, and the workpiece presses against the lower die during a forming operation and is therefore supported at one end thereof in the ram and at another end thereof on the workpiece.

6. Press as claimed in claim 1, wherein the supporting device includes at least one hydraulic cylinder operatively connected to a hydraulic system that supplies a pressurized hydraulic fluid to the hydraulic cylinder.

7. Press as claimed in claim 1, wherein the hydraulic system includes at least a first hydraulic pressure accumulator and at least a second hydraulic pressure accumulator.

8. Press as claimed in claim 2, wherein the reversing valve is electronically controlled for controlling hydraulic fluid flow from the hydraulic cylinder.

9. Press as claimed in claim 1, wherein the sensor device includes at least a force sensor configured to detect at least a portion of the force exerted on the workpiece.

10. Press as claimed in claim 9, wherein the control unit is configured to monitor a time characteristic of the detected force and to suddenly increase the force exerted by the supporting device when the time characteristic of the monitored force deviates by more than a predetermined measure from a value that is predetermined as a function of time.

11. Press as claimed in claim 1, wherein the control unit is configured to determine a rate of change of a time characteristic, and the force exerted by the supporting device is increased suddenly when the rate of change exceeds a predetermined limit.

12. Press as claimed in claim 11, wherein the control unit is configured to determine the rate of change of the time characteristic for only a limited section of a path of the ram path.

* * * * *